US008950832B2

(12) United States Patent
Schag

(10) Patent No.: US 8,950,832 B2
(45) Date of Patent: Feb. 10, 2015

(54) MODULAR SOLID SURFACE STRUCTURE

(71) Applicant: Futrus, LLC, Mansfield, OH (US)

(72) Inventor: Mark Allen Schag, Mansfield, OH (US)

(73) Assignee: Futrus, LLC, Mansfield, OH (US)

( * ) Notice: Subject to any disclaimer, the term of this patent is extended or adjusted under 35 U.S.C. 154(b) by 16 days.

(21) Appl. No.: 13/793,538

(22) Filed: Mar. 11, 2013

(65) Prior Publication Data

US 2014/0252934 A1 Sep. 11, 2014

(51) Int. Cl.

| | |
|---|---|
| ***A47G 29/00*** | (2006.01) |
| ***A47B 96/20*** | (2006.01) |
| ***A47B 96/00*** | (2006.01) |

(52) U.S. Cl.

CPC ..... *A47B 96/20* (2013.01); *A47B 96/00* (2013.01)

USPC ..... 312/265.1

(58) Field of Classification Search

CPC ..... A47B 47/03; A47B 47/05; F16B 12/08; F16B 12/42; H02B 1/301; H02B 1/30

USPC ..... 312/265.1–265.4

See application file for complete search history.

(56) References Cited

U.S. PATENT DOCUMENTS

| | | | | | |
|---|---|---|---|---|---|
| 3,482,895 | A * | 12/1969 | Becklin | 312/352 |
| 3,719,303 | A * | 3/1973 | Kronenberger | 220/592.1 |
| 4,235,493 | A * | 11/1980 | Bridges et al. | 312/265.3 |
| 5,341,595 | A * | 8/1994 | Griggs et al. | 47/60 |
| 5,791,752 | A * | 8/1998 | Hartman | 312/204 |
| 6,017,107 | A * | 1/2000 | Elliott et al. | 312/265 |
| 6,179,398 | B1 * | 1/2001 | Martin | 312/265.4 |
| 6,657,861 | B2 * | 12/2003 | Irmer | 361/695 |
| 6,811,045 | B1 * | 11/2004 | Masker et al. | 211/153 |
| 6,945,616 | B2 * | 9/2005 | Webster et al. | 312/265.3 |
| 7,277,273 | B2 * | 10/2007 | Smith et al. | 361/679.01 |
| 2004/0007951 | A1 * | 1/2004 | Holighaus et al. | 312/265.4 |
| 2006/0267464 | A1 * | 11/2006 | Wyatt et al. | 312/265.4 |
| 2007/0052333 | A1 * | 3/2007 | Freire | 312/265.4 |
| 2009/0071916 | A1 * | 3/2009 | Becklin | 211/26 |
| 2010/0187148 | A1 * | 7/2010 | Becklin | 206/521 |
| 2013/0069505 | A1 * | 3/2013 | Bennett et al. | 312/228 |
| 2013/0285517 | A1 * | 10/2013 | Wach et al. | 312/114 |

* cited by examiner

*Primary Examiner* — Hanh V Tran

(74) *Attorney, Agent, or Firm* — Sand & Sebolt

(57) ABSTRACT

A solid surface structure including a skin engaged to a support frame by a flexible engaging member. The skin is disposed adjacent the support frame. The engaging member preferably is a layer of adhesive that flexibly engages the solid surface to the support frame while simultaneously allowing the solid surface to expand and contract in a relative manner to the support frame when the solid surface structure is exposed to a change in ambient temperature.

20 Claims, 4 Drawing Sheets

MODULAR SOLID SURFACE STRUCTURE

BACKGROUND OF THE INVENTION

1. Technical Field

The technical field relates to modular solid surface structures. More particularly, a solid surface structure comprising a skin engaged to a support frame, where a flexible engaging member secures the solid surface to the support frame and allows the solid surface to expand and contract on the support frame within a given range of relative change, according to variance in temperature.

2. Background Information

When making furniture or other household items, it is generally desirable to reduce the number of components and assembly steps. By reducing the number of components (i.e., panels), the selected piece of furniture is easier to keep clean as there are less nooks and crevasses into which bacteria, dirt and grime can reach.

A solid surface countertop is a countertop fabricated using man-made materials such as those composed of a variety of marble dust, acrylics, polymers, or resins. Solid surface countertops are ordinarily used as these surfaces are non-porous and low-maintenance.

Preferably the solid surfaces are engineered composites that are impervious to bacteria, staining and most problems ordinary encountered by or inherent in natural stone, such as granite. Solid surfaces can be heated and bent into three-dimensional shapes using a process known as thermoforming. The thermoforming process provides a seamless edge. The seamless edge is a major appeal of solid surfaces countertops to consumers and designers. Further, the seamless edges molded through the thermoforming process create a unibody design. The unibody design reduces the number of panels needed and makes the solid surface countertop easier to keep clean.

The inherent thermodynamic properties of solid surfaces cause them to expand or contract, even if slightly, depending on the surrounding temperature. Similarly, the frame or base onto which the solid surface is applied will tend to expand or contract in accordance with the surrounding temperature. Problems arise when the rate of expansion or contraction of the solid surface is different to that of the frame upon which the solid surface is mounted. When this is the case there is a tendency for gaps to develop between the two components, thus providing locations in which bacteria and molds can grow. This is particularly problematic for solid surfaces used in locations which are required to be sterile, such as in doctor's offices, or other healthcare settings.

Some designers overcome this obstacle by mounting or attaching the solid surface to a base that has similar thermodynamic properties so the solid surface and base expand or contract in a relatively similar nature.

Thus there still exists a need for an improved way of mounting a solid surface to a support frame having different thermodynamic properties than the solid surface.

BRIEF SUMMARY OF THE INVENTION

The following summary is intended to introduce the reader to this specification but not to define any invention. One or more inventions may reside in a combination or sub-combination of apparatus elements or process steps described in this summary or in other parts of this document, for example the detailed description or the claims.

The present invention provides a solid surface structure including a skin disposed adjacent to a support frame. The skin is engaged to the support frame by a flexible engaging member. In particular, the flexible engaging member is a layer of an adhesive applied between the solid surface and the support frame. Most particularly, the flexible engaging member is a layer of a semi-permanent adhesive. This layer of adhesive preferably is applied when the difference between the coefficient of thermal expansion of the skin relative to the coefficient of thermal expansion of the support frame is from about 0% to about 60%, and is most particularly about 31.67%.

The present invention also provides a solid surface with a seamless edge capable of expanding or contracting relative to the support frame through the use of an adhesive.

The present invention further provides a solid surface custom designed and uniquely formed to create a piece of casework, furniture, or household item adhesively engaged to a structural support frame.

The present invention provides a solid surface structure comprising a skin having a first coefficient of thermal expansion, a support frame having a second coefficient of thermal expansion, wherein said first coefficient is different than said second coefficient, wherein there is a relative change ratio of the first coefficient and the second coefficient and the relative change ratio is from about 0% to about 60%, and an engaging member, wherein said engaging member engages said solid surface to said frame and said engaging member flexibly permits said solid surface to expand and contract relative to the support frame.

The present invention provides a solid surface structure comprising a skin having a first coefficient of thermal expansion, a support frame having a second coefficient of thermal expansion, wherein said first coefficient is different than said second coefficient, a gap defined between the solid surface and the support frame, and an engaging member disposed within the gap, where said engaging member engages said solid surface to said support frame and permits said solid surface to expand and contract relative to the support frame in response to changes in temperature.

The present invention further provides a method of constructing a solid surface structure comprising the steps of: first, thermoforming a skin having a first coefficient of thermal expansion to a desired shape; next, building a support frame having a second coefficient of thermal expansion; and finally, attaching said solid surface to said support frame via an engaging member, where said engaging member flexibly permits said solid surface to expand and contract relative to the support frame; and wherein a relative change ratio of the first coefficient to the second coefficient is from about 0% to about 60%.

BRIEF DESCRIPTION OF THE SEVERAL VIEWS OF THE DRAWINGS

Preferred embodiments of the invention, illustrated of the best mode in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Various devices or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors, and owners reserve all rights in any invention disclosed in an apparatus or process described below that is not claimed in this document, for example the right to claim such an invention in a continuing application, and do not abandon, disclaim or dedicate to the public any such invention by its disclosure in this document.

The term "skin" in the sense of this description and accompanying claims means a manmade solid surface material usually composed of marble dust, bauxite, acrylic, acrylic polymers, alumina trihydrate, or polyester resins and pigments. Preferably this "solid surface" is in the form of a planar sheet that is rigid or flexible in nature.

Figure 1:
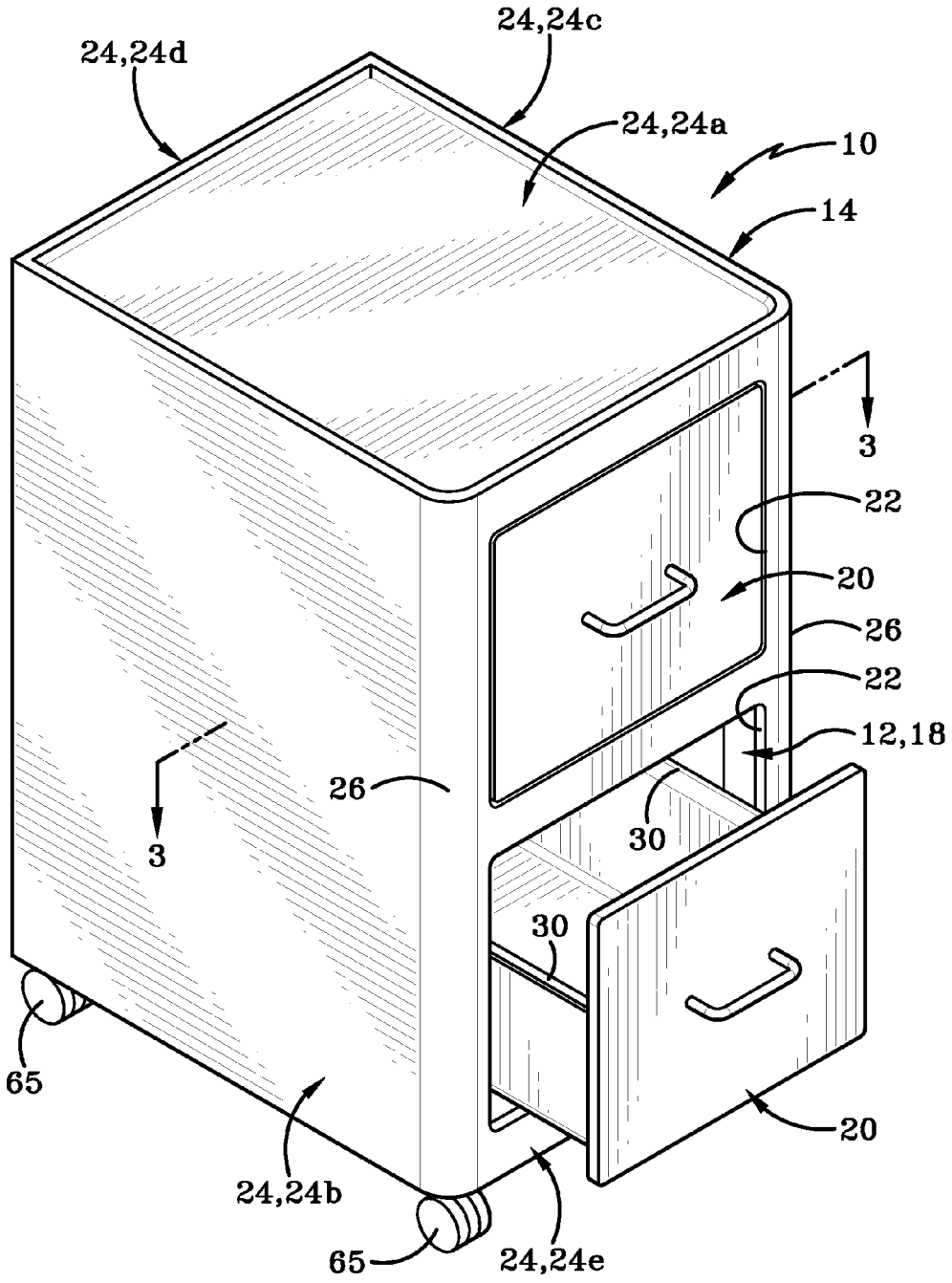
FIG. 1 is a perspective view of the solid surface structure.

Referring now to FIG. 1, there is shown a solid surface structure 10 in accordance with the present invention. The illustrated solid surface structure 10 is a filing cabinet and is shown in a perspective view having two drawers 20. While this exemplary design is shown it is not intended to be limiting and the solid surface structure 10 can take on any of a variety of configurations to satisfy the needs of a user. For example, the solid surface structure 10 may be configured as a generally planar countertop or it may be configured as a coffee table having a flat top and four legs extending downwardly therefrom. Further, the skin may be fabricated in a variety of solid-surface colors and custom dye-sublimation wood grain styles.

Figure 2:
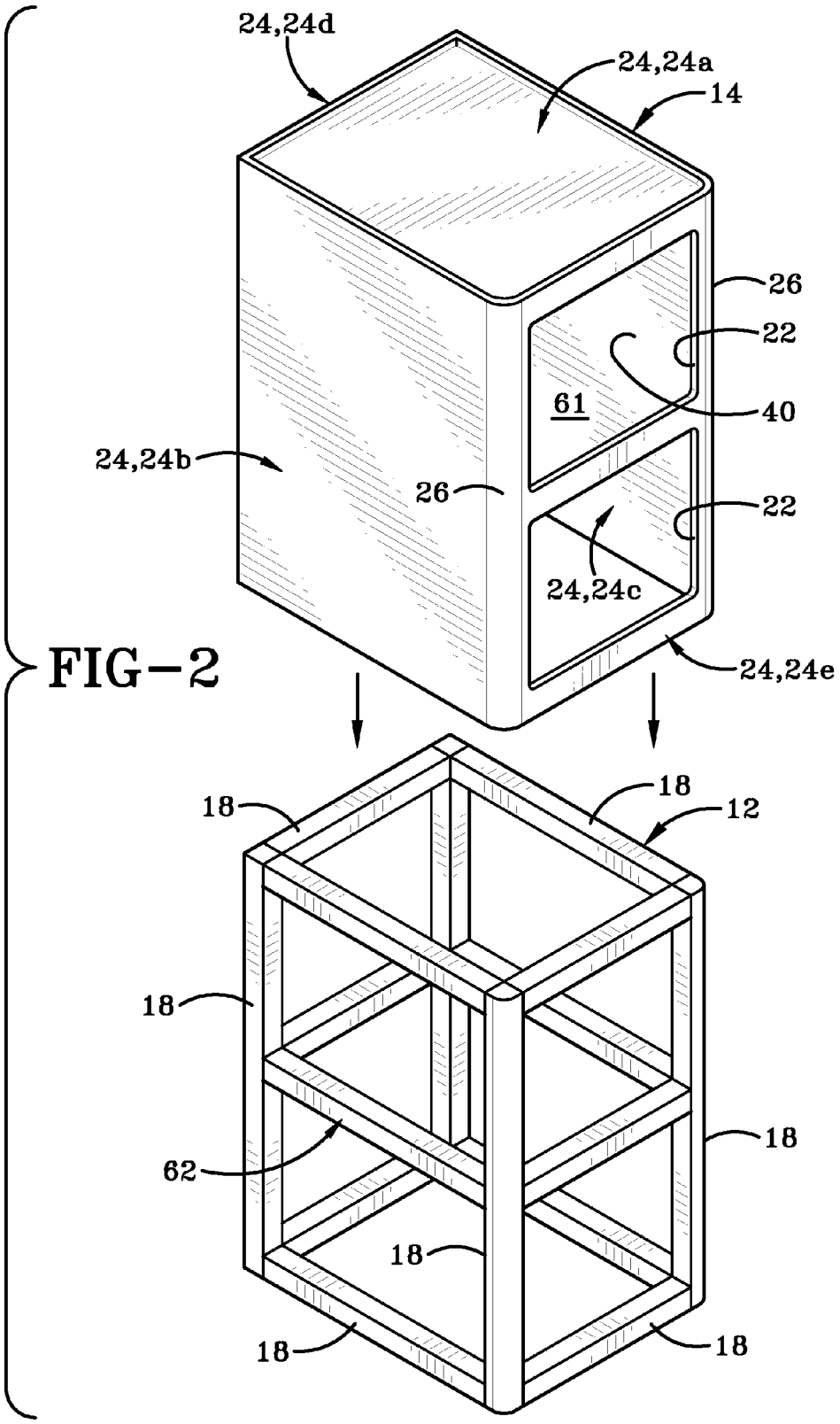
FIG. 2 is an exploded perspective view showing the skin and the support frame and their adjacent relationship.

FIG. 2 provides an exploded view of the solid surface structure 10. The structure 10 includes a support frame 12 and a skin 14. In the specific configuration of solid surface structure 10 illustrated in FIGS. 1 and 2, the frame 12 is shaped in a manner to allow the skin 14 to integrally nest with and be supported by the frame 12. It will be understood that in other configurations, such as in generally flat countertops, for example, skin 14 will be disposed adjacent frame 12 as opposed to being nested therewith.

The support frame 12 comprises a plurality of frame members 18. As indicated above, each frame member 18 preferably is comprised of aluminum. Aluminum is the preferred material as it has a high strength to weight ratio, is non-magnetic and therefore able to be used in healthcare type environments, and is less prone to degradation if exposed to moisture. Additionally, aluminum is lighter in weight than steel and is stronger than wood. Preferably, the aluminum selected for frame members 18 is made up of about 65% post-consumer recycled content. Finally, in the specific application described herein where Corian® is the preferred material for skin 14, the expansion rate of aluminum is closer to that of Corian® than is the expansion rate of steel, for example.

Furthermore, unlike other metals such as steel, aluminum frame members 18 may be easily secured to each other by means other than welding, preferably by using a plurality of nuts and bolts. Depending on the type of nuts and bolts used for this purpose, there is a minimum torque and a maximum torque which must be applied to the nuts and bolts. For example, if ¼-20 FBHSCS fasteners are used as end fasteners for 1"×1" aluminum frame members, then the minimum torque that typically would be applied is thirteen pounds per foot and the maximum torque is eighteen pounds per foot. Preferably, however, the nuts and bolts used in solid surface structure 10 are tightened to a minimum torque of eighteen pounds per foot as this has been found to reduce vibrations in frame 12. A reduction of frame 12 vibrations prevents skin 14 from cracking or otherwise failing.

The frame members 18 are arranged and secured to each other to form and define said frame 12. As shown in FIG. 1, for example, the frame members 18 are used to construct a support frame that is generally a rectangular cube in shape. The members preferably are elongated and hollow and have a generally rectangular cross section. Although the members have a rectangular cross section, other structurally sound designs are possible, such as a round cross section providing tubular members, or a member having a generally triangular cross section. Further, while it is contemplated that the plurality of frame support members 18 will be made of aluminum, steel or other materials having similar coefficients of thermal expansion can also be used to form the members. The coefficient of thermal expansion for the aluminum frame members 18 defining the support frame 12 is 1.23×10-5 in./in./° F.

The frame members 18 can be formed in any conventionally known manner that provides strength to said members. Known strengthening and forming processes include but are not limited to punching, extracting, extruding, or forming. Further, while these formation processes are contemplated other means of producing the support members 18 is contemplated as well.

The frame members 18 preferably are powder coated to provide a high quality and aesthetically pleasing finish to the support frame 12.

The skin 14 is a man-made material designed to be non-porous and low-maintenance. The skin 14 is durable, repairable and adaptable. Further, the skin 14 is renewable as stains or scratches can be easily buffed out to keep the skin looking like new. The skin 14 is resistant to water degradation and does not support the growth of mold, mildew, or bacteria. The skin 14 may be anti-bacterial or anti-microbial.

The preferred skin used with the present invention is Corian®. Corian® is a type of solid owned and manufactured by E.I. Du Ponte De Nemours and Company incorporated in Wilmington, Del. Corian® has a coefficient of thermal expansion rate of 1.80×10-5 in./in./° F. which yields a thermal expansion distance about 1 mm per meter with a change of 30° C.

The skin 14 is thermoformed and is comprised of a plurality of solid panels 24, each engaged with each other so as define the entire skin 14. In particular, the skin 14 comprises a top planar panel 24*a*, two planar side panels 24*b*, 24*c*; where each side panel extends downward from said top planar panel 24*a* and is engaged to top planar panel 24*a* via a solid edge 26. The solid edge 26 is contemplated as being rounded. The skin 14 further has a rear planar panel 24*d*, said rear planar panel 24*d* extending downward from said top planar panel 24*a* and engaged to top planar panel 24*a* and each planar side panel 24*b*, 24*c* via a rounded edge 26. The skin 14 further comprises a front panel 24*e* having at least one panel aperture 22 defined by said front panel 24*e*, said at least one panel aperture 22 aligned and is in fluid communication with said frame aperture 22, said front panel 24*e* extending downward from said top planar panel 24*a* and engaged to said top planar panel 24*a* and each planar side panel 24*b*, 24*c* via a solid edge 26. When engaged together or thermoformed as one skin 14, the panels 24 form a continuous inner surface 61. An inner cavity 40 is a bounded space defined by the continuous inner surface 61. Said inner cavity 40 nestingly mates with said support frame 18.

As seen throughout the Figures, the solid panels are planar and face multiple directions and can be molded to have desirable features including by way of example and not limitation cup holders, recesses, retaining means, brackets, and other known desirable aesthetic or functional features. While the Figures depict the panels 24*a-e* engaged via a rounded or coved edge 26, other desired edge finishes can be incorporated, such as a chamfered edge.

The skin 14 has an inner surface 61 (FIG. 4) which defines the cavity 40 that nestingly receives the support frame 12. The cavity 40 is integrally engaged to the aperture 22 to receive the drawer 20. In accordance with a specific feature of the present invention, a gap 42 (FIG. 4) is defined between frame 12 and skin 14. In particular, gap 42 is defined between inner surface 61 of skin 14 and an outer surface 62 of frame 12. Preferably, gap 42 is equal to or greater than 1/16 of an inch (i.e., equal to or greater than 1.5 mm) in width.

Figure 3:
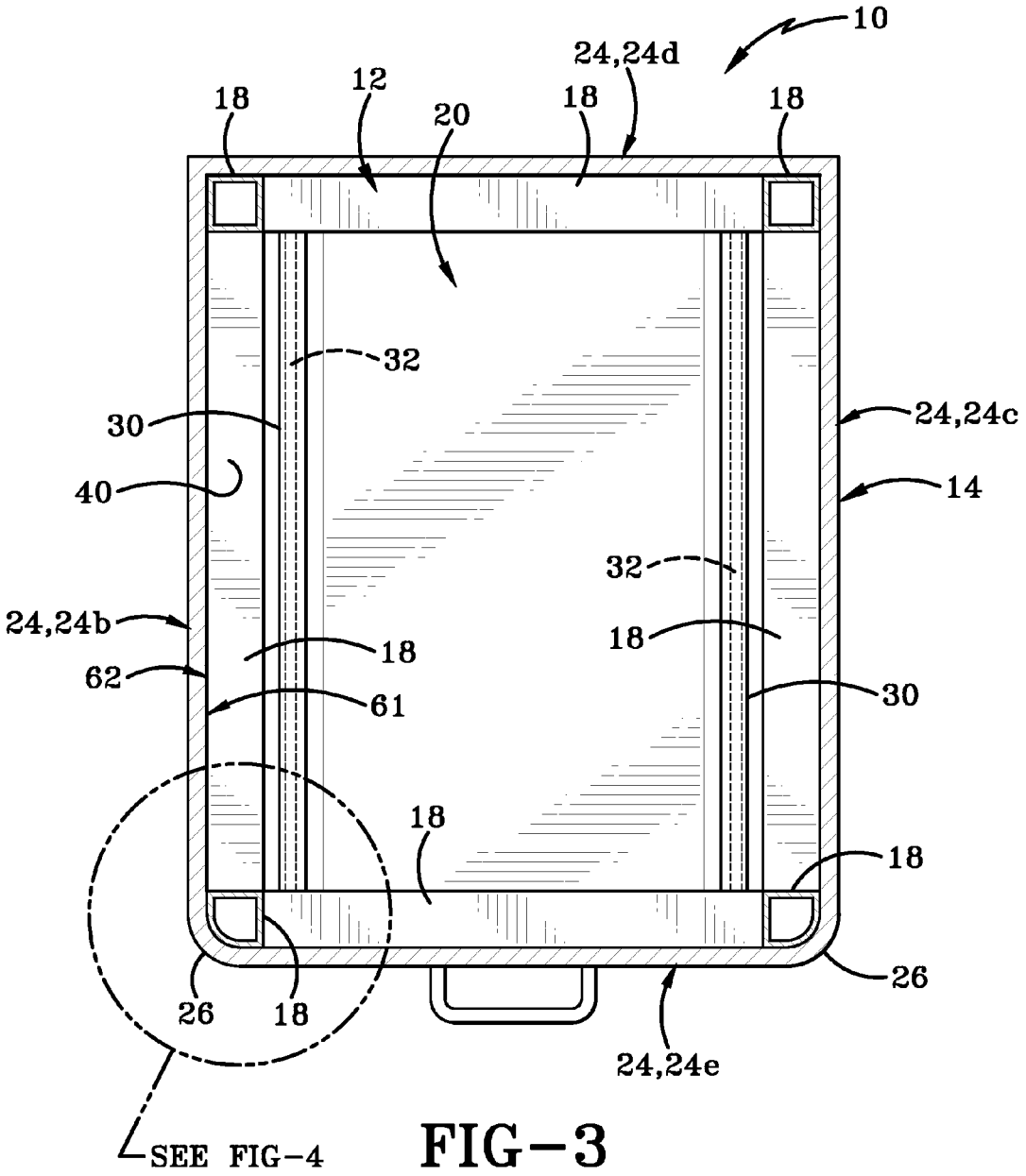
FIG. 3 is a horizontal cross section of the solid surface structure looking down across the horizontal cross section 3-3 shown in FIG. 1.
Figure 4:
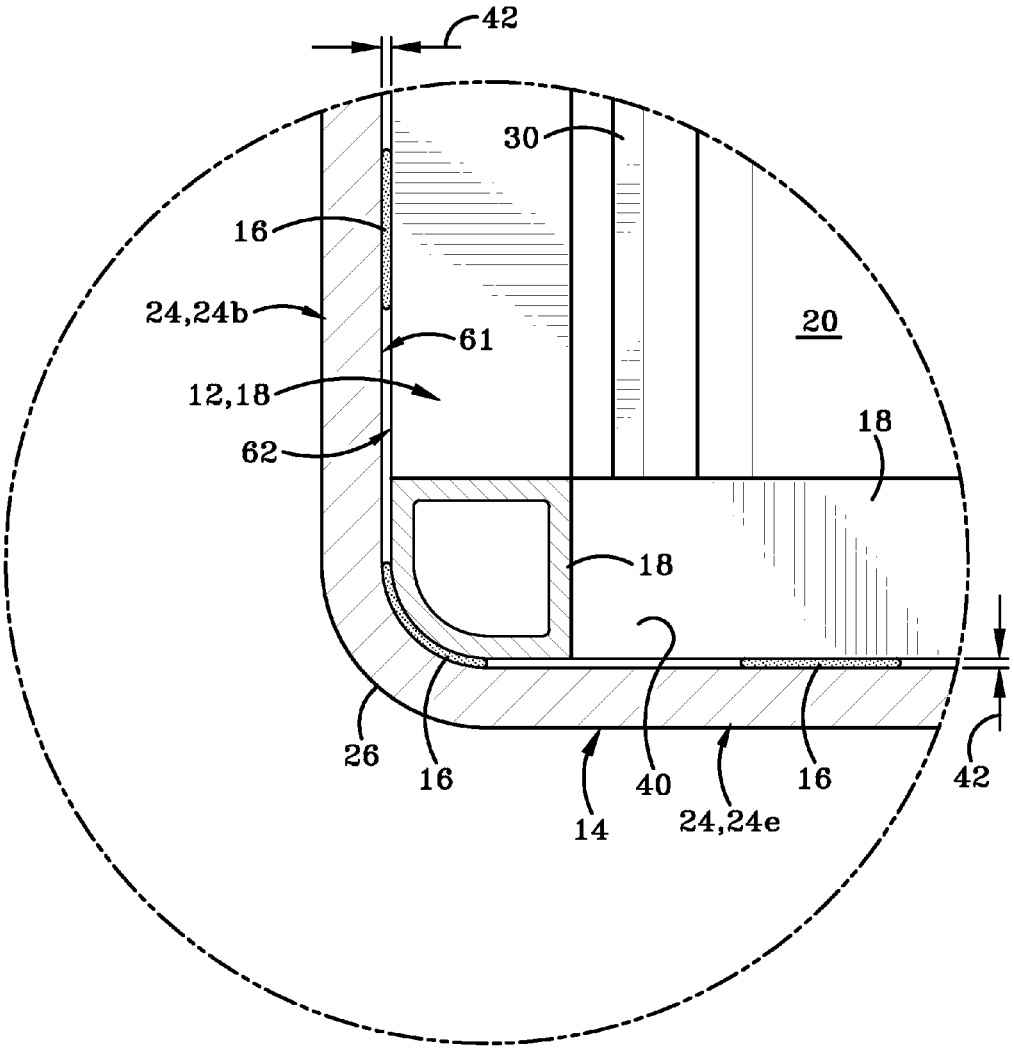
FIG. 4 is an enlarged horizontal cross section detailing the skin engaged to the support frame via the adhesive.

As best shown with FIG. 2-4, an engaging member 16 flexibly engages skin 14 to the support frame 12. Engaging member 16 is received within this gap 42. The engaging member 16 permits the skin 14 to expand or contract relative to the support frame 12. The expansion or contraction is dependent on a surrounding ambient or proximate source temperature.

The engaging member 16 of preferred embodiment of the present invention is an adhesive. The adhesive may be permanent or semi-permanent, however the preferred adhesive is a semi-permanent adhesive. The term "semi-permanent" is used to indicate that the adhesive is of a type which may be removed at a later stage, should that be desired.

Further, the engaging member 16 is applied into the gap 42 and thus the applied thickness of the adhesive to the support frame 12 preferably is greater than or equal to 1/16". The adhesive preferably is applied in vertically or horizontally apart regions, such as illustrated in FIG. 4. Alternatively, the adhesive may be applied over substantially the entire inner surface of skin 14. The engaging member 16 thus creates a flexible connection between the support frame 12 and the skin 14 thereby allowing the skin 14 to expand or contract relative to support frame 12, depending on the ambient temperature i.e., the temperature of the air surrounding solid surface structure 10.

The preferred embodiment of the present invention utilizes the adhesive commercially known as MS35. Preferably the MS35 adhesive used in the present application is that sold under the trade name Chem-Set™ MS35 fabricated or sold by Chemical Concepts, Inc. of Huntingdon Valley, Pa.

Further a specific feature of the engaging member 16 is its flexibility. Flexible properties allow the skin 14 and support frame 12 to expand or contract at different rates while remaining semi-permanently attached to each other. This feature gives designers a broader array of materials, to use in the manufacture of the support frame. For example, it was previously problematic to use aluminum in these types of applications. However, with the incorporation of a flexible engaging member between support frame 12 and skin 14, it is now possible to use aluminum frame members in constructing frame 12.

In order to secure the skin 14 to the support frame 12, the support frame 12 surfaces must be prepared to receive the engaging member 16. When the engaging member 16 is a semipermanent adhesive, skin 14 is prepared in a specific manner prior to applying the adhesive. It is contemplated that the support frame 12 will be a non-porous metal, such as aluminum. The non-porous support frame 12 should be prepared for adhesive application by a rag wipe method using denatured alcohol, xylene or an approved commercial solvent. The solvent is then allowed to evaporate prior to applying the semi-permanent adhesive.

In the event that a porous material is used to construct the support frame 12, a porous surface of the support frame 12 requires preparation prior to cleaning by mechanical methods to expose a sound surface free of contamination and laitance. The adhesive 16 is applied to the support frame 12 in locations that are adjacent the skin 14.

In the filing cabinet illustrated in the accompanying figures, the frame members 18 are arranged so as to define two apertures 22, each sized and configured to accept a drawer 20, and into which a drawer 20 will be inserted, as will be hereinafter described. The drawer 20 has a bottom, left side, right side, front, and back. These are arranged to define a top opening and form a drawer cavity into which contents may be placed. The drawer 20 preferably is made from powder coated steel. The aperture 22 accepts at least a major portion of the drawer 20. Conventionally known attaching means 30 for slidably engaging a drawer 20 to the support frame 12, are used, by way of example and not limitation, runners, tongue and grove slides, roller bearing slides, channel slides, etc. The attaching means 30 are secured to frame 12 and not to skin 14. The attaching means 30 extend at least partially toward the rear of the structure 10. The drawer 20 extends inward and outward of aperture 22 on the attaching means 30. It is contemplated that the drawer 20 will be able to move inward and outward by ridges 32 extending horizontally across the length of the sides of the drawer 20. These ridges 32 slide into or along the attaching means 30. The ridges 32 of the drawer 20 engage in a lateral interference fit so that when the drawer 20 is inserted, the attaching means 30 is between the sides of the drawer 20 and the inner surface 61 of the skin 14. Further, the ridges 32 preferably include at least one integrated detent which protrudes therefrom and towards the attaching means 30 so as to prevent a person from inadvertently pulling the drawer 20 too far out from the support frame 12.

The absolute difference between the coefficients of thermal expansion for a support frame 12 made of aluminum and a skin 14 made of Corian® is about 0.57×10-5 in./in./° F. (1.80×10-5 in./in./° F. minus 1.23×10-5 in./in./° F.). The term "absolute" used throughout this description and accompanying claims shall mean the mathematical absolute value, i.e., the non-negative value of a number. For example, the absolute value of 3 is 3. The absolute value of −3 is 3.

The relative change ratio between the coefficient of thermal expansion for aluminum and Corian® is found dividing the absolute difference by the known thermal expansion coefficient for Corian®, yielding a relative change of 31.67% (0.57×10-5 in./in./° F. divided by 1.80×10-5 in./in./° F. equals 31.67%).

The solid surface structure 10 as fabricated above has a relative change ratio between the coefficient of thermal expansion for the support frame 12 and the skin 14 from about 0% to about 60%.

Further, the solid surface structure 10 has available options to add on to satisfy the needs of the end user. Specifically, FIG. 1-4 provides a set of caster wheels 65 engaged to the bottom of the solid surface structure 10 to allow for freedom of movement. Although it is not illustrated herein, an alternate embodiment of the present invention comprises a solid surface cabinet which has an aperture defined therein similar to the aperture 22 in solid surface structure 10 which receives the drawer 20. One or more hinges are utilized to rotatably mount a door to the support frame for the cabinet. The door may be rotated between an open and closed position and when in the closed position, the door will prevent access into the interior cavity of the solid support structure.

The solid surface structure 10 is constructed by thermoforming the skin 14 to a desired shape. The thermoformed skin 14 has a first coefficient of thermal expansion. The thermoforming process can be done through conventionally known means as would be understood by a person having ordinary skill in the art.

The frame 12 is constructed. The frame 12 is comprised of members 18 having a second coefficient of thermal expansion. As indicated previously, the frame 12 can be a variety of structurally sound shapes or designs.

The engaging member 16 is applied to the frame 12. Particularly, the engaging member 16 is applied at a thickness greater than or equal to 1/16 of an inch. The skin 14 is then nested with the frame 12 and is thereby disposed adjacent the engaging member 16. Pressure is applied to one or both of the skin 14 and frame 12 to sandwich the engaging member 16 into the gap 42 between skin 14 and frame 12. Engaging member 16 flexibly engages the skin 14 to the frame 12. When flexibly engaged, the relative change ratio of the first coefficient to the second coefficient is from about 0% to about 60%.

At least one attaching means 30 is connected to the frame 12 before or after application of skin 14 thereto. Attaching means 30 extends at least partially towards the rear panel, in linear alignment with the aperture 22. The drawer 20 extends inward and outward of aperture 22 on the attaching means 30.

The present application should contemplate all equivalents recognized to a person having ordinary skill in the art. By way of example and not limitation: the engaging member could be a rubber member instead of an adhesive; the adhesive could be a two-component rather than a one-component; the skin could have a different commercial trade name and have different internal or inherent characteristics; the support frame could be made of a porous material having different internal or inherent characteristics.

It will be understood that while the attached figures and the description indicate that the skin is applied to an outer surface of the support frame, the skin may instead be applied to an inner surface of the support frame. In this latter instance, the gap between the skin and the support frame will be defined between an inner surface of the support frame and an outer surface of the skin. As before, the flexible engaging member 16, i.e., the adhesive, will be applied in this gap.

It will further be understood that a skin may be applied to each of the inner and outer surfaces of the support frame so that the support frame is effectively sandwiched or juxtaposed between the skins.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A solid surface structure comprising:

a solid surface skin having a first coefficient of thermal expansion and a bottom opening defining a cavity;

a support frame consisting essentially of aluminum nestingly positioned within the cavity to support the solid surface skin atop the frame and having a second coefficient of thermal expansion, wherein said first coefficient is different than said second coefficient;

a gap defined between the solid surface skin and the support frame; and an engaging member disposed within the gap, wherein said engaging member engages said solid surface skin to said support frame and permits said solid surface skin to expand and contract relative to the support frame in response to changes in temperature.

2. The structure of claim 1, wherein said engaging member flexibly permits said solid surface skin to expand and contract relative to the support frame; and wherein there is a relative change ratio of the first coefficient to the second coefficient when the solid surface skin is so engaged to the frame; and the relative change ratio is from about 0% to about 60%.

3. The structure of claim 2, wherein said relative change ratio is 31.67%.

4. The structure of claim 1, wherein said engaging member is an adhesive.

5. The structure of claim 4, wherein said adhesive is a semi-permanent adhesive.

6. The structure of claim 4, wherein the adhesive is applied in a thickness and the applied thickness of said adhesive is 1/16 of an inch or more than 1/16 of an inch.

7. The structure of claim 4, wherein said support frame comprises:

a plurality of members engaged together to form said frame; and at least one frame aperture defined by said members.

8. The structure of claim 7, wherein said solid surface skin further comprises:

a. a top planar panel, b. two planar side panels, each side panel extending downward from said top planar panel and engaged to said top planar panel via a solid edge;

c. a rear planar panel, said rear planar panel extending downward from said top planar panel and engaged to each of said top planar panel and said planar side panels via a solid edge;

d. a front panel extending downward from said top planar panel and engaged to each of said top planar panel and said planar side panels via a solid edge; and wherein the top, side, rear and front panels form a substantially continuous inner surface;

e. an inner cavity is a bounded spaced defined by said inner surface; and wherein the solid surface skin is adjacent to said support frame within said inner cavity; and f. a panel aperture defined in said front panel; wherein said panel aperture is aligned and in fluid communication with said frame aperture when the solid surface skin is adjacent to the support frame.

9. The solid surface structure of claim 8, further comprising a drawer; and wherein said aligned panel aperture and frame aperture receives at least a major portion of the drawer therein.

10. The solid surface structure as defined in claim 9, wherein the support frame further comprises:

a. at least one attaching member disposed on a member defining the frame aperture; and wherein said attaching member slidably engages said drawer to said support frame, wherein said at least one attaching member extends at least partially toward the rear panel of the solid surface structure; and b. said drawer is movable into and out of the aligned frame aperture and panel aperture on the attaching member.

11. The solid surface structure as defined in claim 10, further comprising:

a first detent extending outwardly from the attaching member; and a second detent on the drawer wherein the first and second detents lockably engage each other.

12. The solid surface structure of claim 1, further the solid surface skin comprising one or more of the following:

marble dust, bauxite, acrylic, acrylic polymers, alumina trihydrate, and polyester resins.

13. The structure of claim 7, further comprising a plurality of nuts and bolts which secure the members together; wherein the nuts and bolts nuts are tightened to a minimum torque of eighteen pounds per foot.

14. A method of constructing a solid surface structure comprising the steps of:

a. thermoforming a solid surface skin having a first coefficient of thermal expansion to a desired shape and a bottom opening defining an interior cavity;

b. building a support frame consisting essentially of aluminum having a second coefficient of thermal expansion;

c. attaching said solid surface skin to said support frame in a nesting relationship with the frame inside the cavity to support the skin atop the frame via an engaging member, where said engaging member flexibly permits said solid surface skin to expand and contract relative to the support frame;

and wherein a relative change ratio of the first coefficient to the second coefficient is from about 0% to about 60%.

15. The method as defined in claim 14, wherein the engaging member is an adhesive; and the step of attaching said solid surface skin to said support frame further comprises the step of:

preparing a support frame surface by wiping said support frame with a solvent and allowing said solvent to dry prior to applying said adhesive.

16. The method as defined in claim 15, wherein the step of attaching said solid surface skin to said support frame comprises the step of: applying a thickness of the adhesive into a gap defined between the solid surface skin and the support frame.

17. The method as defined in claim 16, wherein the step of applying the adhesive includes applying a layer of adhesive to a thickness of 1/16 of an inch or more into the gap between the solid surface skin and support frame.

18. The method as defined in claim 14, wherein the step of building a support frame further comprises the steps of:

forming at least one aperture by arranging a plurality of frame members to bound a space; and securing said arranged frame members together.

19. The method as defined in claim 18, wherein the step forming the aperture further comprises:

mounting at least one attaching means to the frame members which bound the aperture.

20. The method as defined in claim 19, further comprising the step of slidably engaging a drawer onto the at least one attaching means.

* * * * *